United States Patent [19]

Seaborn et al.

[11] 3,968,546

[45] July 13, 1976

[54] ONE-PIECE COMBINATION CLIP

[75] Inventors: Paul E. Seaborn, Los Gatos, Calif.; John R. Wyant, Marietta, Ga.

[73] Assignee: The Mead Corporation, Dayton, Ohio

[22] Filed: Jan. 13, 1975

[21] Appl. No.: 540,657

[52] U.S. Cl. ..... 24/67.9; 24/67.11; 281/15 B

[51] Int. Cl.[2] ..... B42F 1/00

[58] Field of Search ..... 281/15 B, 45; 24/67 R, 24/67.1, 67.3, 67.5, 67.7, 67.9, 67.11

[56] References Cited

UNITED STATES PATENTS

| | | | |
|---|---|---|---|
| 590,175 | 9/1897 | Trussell | 24/67.7 |
| 951,052 | 3/1910 | Brown | 24/67.11 |
| 1,053,725 | 2/1913 | Gates | 24/67.11 |
| 2,730,781 | 1/1956 | Alunas | 24/67.9 |
| 2,783,062 | 2/1957 | Helberg | 24/67.7 |
| 2,996,774 | 8/1961 | Sutton | 24/67.7 |
| 2,996,775 | 8/1961 | Vernon | 24/67.7 |
| 3,153,417 | 10/1964 | Newman | 402/41 |
| 3,195,253 | 7/1965 | White | 24/67.11 |
| 3,212,794 | 10/1965 | Crossan et al. | 281/15 B |
| 3,845,521 | 11/1974 | McNichol | 24/67.9 |

FOREIGN PATENTS OR APPLICATIONS

| | | | |
|---|---|---|---|
| 1,171,872 | 6/1964 | Germany | 24/67.9 |

*Primary Examiner*—Jerome Schnall
*Attorney, Agent, or Firm*—Biebel, French & Nauman

[57] ABSTRACT

A one-piece molded clip for holding a tablet or sheets of paper on a clip board or other supporting structure and including a pencil or pen holder formed integrally with the clip. The clip has a base portion which may either be provided with openings for rivets to attach the clip to a supporting structure or with integrally formed studs. A spring is integrally formed with the base and consists of a first wall which projects upwardly from the base and a second wall which projects outwardly and downwardly and terminates in a gripper disposed beneath the plane in which the lower surface of the base lies to provide increased gripping power when the clip is attached to a surface. The pen or pencil holder consists of a slot defined by the upwardly projecting wall of the spring and another wall extending in spaced, approximately parallel relationship thereto.

4 Claims, 10 Drawing Figures

ONE-PIECE COMBINATION CLIP

BACKGROUND OF THE INVENTION

There are a number of clip constructions adapted to hold a tablet or sheets of paper on a clip board or other supporting structure, and a common approach taken in manufacturing clips of this type is to form them from steel or similar, metallic material, which possess substantial inherent resiliency and provides the gripping action necessary to hold a tablet or several sheets of paper. For example, see U.S. Pat. Nos. 1,506,147; 1,688,429; 3,023,474; and 3,195,253. In each of these patents a metallic clip is formed by bending and/or stamping and cutting a piece of metal to form a one-piece clip, which in some cases may also have provision for holding a pen or pencil.

While such clips may perform satisfactorily, it will be apparent that each requires at least several separate bending operations and may additionally require cutting, stamping and riveting to shape a piece of metal into the desired configuration. Therefore, while many clips of this type are relatively simple in operation and appearance, often the manufacturing operations required to produce the clip are not of commensurate simplicity.

Another common type of clip is that formed of more than a single component, wherein the gripping action is attained by hingedly connecting two members together and providing a spring to urge a gripping portion of the clip into contact with a tablet or sheets of paper. Examples of this type of clip are shown in U.S. Pat. Nos. 3,127,649 and 3,246,914. Obviously such clips, similarly to the one-piece clip discussed above, require several steps in their manufacture which result in increased manufacturing costs.

SUMMARY OF THE INVENTION

The present invention provides a one-piece clip which can be produced from relatively inexpensive synthetic resinous materials using essentially conventional injection molding techniques. Through the specific design of the components of the clip and the interrelationship of these components to each other, a clip is provided which produces superior gripping qualities, despite the somewhat limited inherent resiliency of those thermoplastic materials which possess the necessary amount of stiffness to provide the durability required for a clip of this type.

Specifically, a clip in accordance with the present invention includes a base from which projects an upstanding wall to which is connected a relatively long downwardly and outwardly projecting wall which terminates in a gripping portion. This structure provides a spring which possesses the necessary resiliency in part because of the relatively great length of the downwardly and outwardly projecting wall.

To compensate for the length of the downwardly and outwardly extending wall of the spring and provide a close fit for the upper edge of the material held by the clip, the base is provided with feet which project outwardly from the base and engage the upper edge of the tablet being held to position it properly on the clip board or other supporting surface.

The resiliency of the clip is increased by forming the upwardly extending wall, as well as the downwardly and outwardly extending wall, relatively long. However, this also results in a rather large space between the lower surface of the spring and the upper surface of the structure to which the clip is attached. To insure that a tablet, sheets of paper or the like held by the clip do not slide up into this space over the ends of the feet projecting from the base portion of the clip, each of the feet may be provided with upwardly extending protrusions designed to extend well above the upper surface of the writing material secured by the clip.

To provide greater gripping force, the outer end of the downwardly and outwardly extending wall of the spring is disposed beneath the plane of the bottom surface of the base portion of the clip. Therefore, when the clip is attached to a supporting surface, the spring of the clip is automatically preloaded.

Extending in spaced, substantially parallel relationship to the wall extending upwardly from the base of the clip is another wall which defines with the upwardly extending wall a slot for receiving a pen, pencil or other writing utensil. The walls defining the pen or pencil slot are, like the other components of the clip, produced in the molding operation and all of the components of the clip are, therefore, formed integrally with each other.

With regard to attaching the clip to a clip board or other supporting surface, the base portion may be provided with openings to receive rivets. Alternatively, studs may be formed integrally with the base portion of the clip to permit the clip to be attached using ultrasonic welding techniques.

In either case the openings or studs are positioned preferably approximately in line with the wall extending upwardly from the base, or approximately at the point where the feet project outwardly from the base. By positioning the fasteners for the clip in this manner it has been found that there is less tendency for the studs or rivets to pull from the supporting surface when the clip is opened.

From the following description it will be apparent that the present invention, therefore, provides a combined clip and pen or pencil holder which may be relatively inexpensively produced by virtue of the fact that the components of the clip and their relationships to each other have been designed to permit the clip to be produced from relatively inexpensive thermoplastic material utilizing essentially conventional molding techniques while still providing a clip of relatively rugged construction and superior gripping capabilities.

DESCRIPTION OF THE PREFERRED EMBODIMENT

Figure 1:
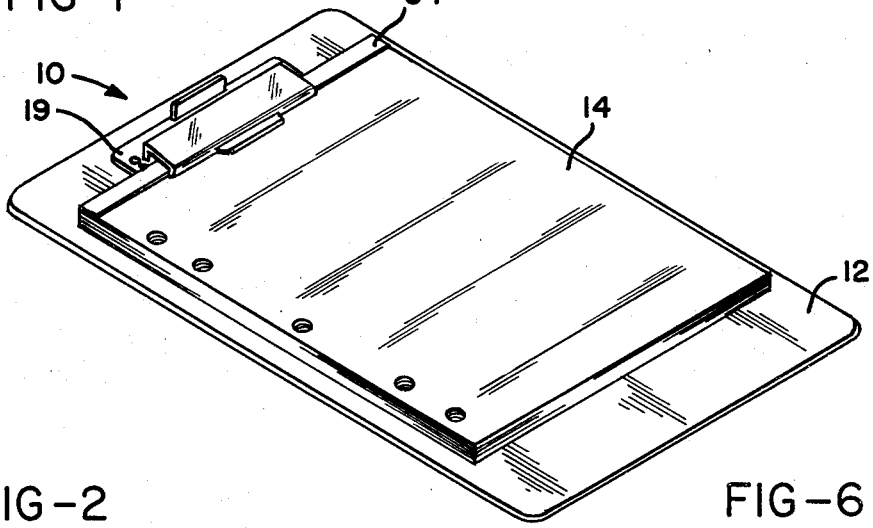
FIG. 1 is a perspective view showing the clip of the present invention attached to a clip board and holding a tablet of paper thereon.

As seen in FIG. 1 of the drawings, the clip 10 of the present invention is adapted to be used in conjunction with a clip board 12 or other supporting surface to hold a tablet 14, several sheets of paper or the like on the supporting surface. While for purposes of illustration a clip board is shown in FIG. 1, it will be apparent that the clip of the present invention may be used with a leaf of the popular three-panel type folios, a supporting surface such as a desk or wall, or in countless other installations.

Regardless of the particular supporting surface to which the clip is attached it will be seen from the several figures of the drawings that the clip includes a base 16 having a lower and upper surfaces 18 and 19. Projecting upwardly from the upper surface of the base of the clip is a first wall 20 and extending downwardly and outwardly from the upper edge of the wall 20 is a second wall 22.

Figure 6:
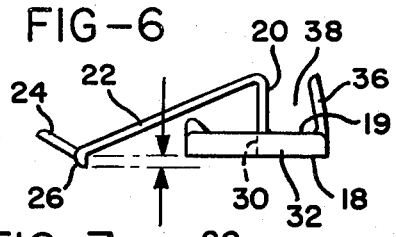
FIG. 6 is a side view of the clip per se.

The walls 20 and 22 define a spring which includes a handle 24 and a gripping portion 26, the latter being disposed, as best seen in FIG. 6 of the drawings, beneath the plane in which the lower surface 18 of the base portion lies. As a result, when the clip is attached to a supporting surface, as seen in FIG. 7, the spring 28 of the clip is automatically preloaded to the desired degree of gripping force.

The resiliency necessary to permit preloading of the clip spring in this manner could be obtained by utilizing a material which possesses a great deal of inherent resiliency. However, with commonly available materials capable of being molded, the desired amount of gripping force would not be obtained using conventional clip configurations. Examples of material suitable for molding are materials sold under the trademarks CELCON and DELRIN.

Figure 7:
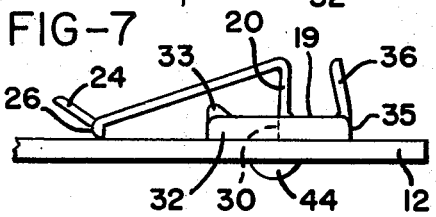
FIG. 7 is a view showing the clip associated with a supporting surface.
Figure 8:
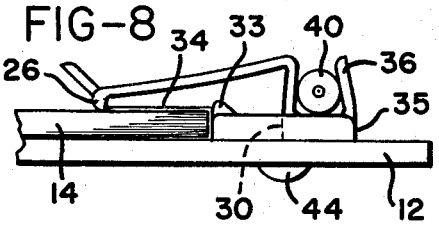
FIG. 8 is a view showing the clip engaging a tablet of paper.
Figure 4:
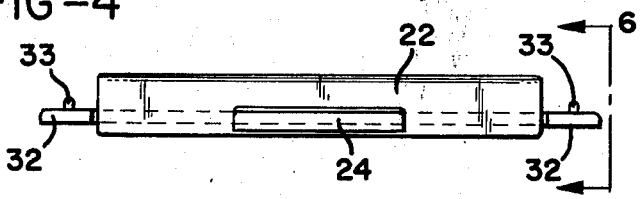
FIG. 4 is an elevational view of the clip viewed from the spring side thereof.

Therefore, to provide the required resiliency and gripping force in the spring 28, it will be noted, particularly from FIGS. 6 through 8 of the drawings, that the wall 22 of the spring is relatively long with respect to the other components of the clip, in excess of a plurality of times the length of wall 20, and in fact projects outwardly and downwardly a substantial distance beyond the forward edge 30 (see also FIGS. 2 and 3) of the clip.

While the relatively great length of the wall 22 provides increased resliency and gripping force, this also results in a relatively large space between the forward edge 30 of the base and the gripping portion 26.

It is desirable, however, that the upper edge of the tablet or other material held by the clip be seated against a portion of the clip to provide stability to the material during use. It will be apparent that if the upper edge of the tablet or sheets were positioned against the edge 30 an appreciable portion of the available writing area would be covered, while if the tablet or sheets are positioned so that only a small portion of the writing area is covered, their upper edges would not be seated. Either situation is undesirable.

To obviate these problems the clip of the present invention provides an abutment against which the upper edge of the tablet, sheets of paper or the like are seated when engaged by the clip. This is accomplished by providing two or more feet 32 which extend outwardly from the base portion 16 beyond the edge 30 thereof. Thus, as best seen in FIGS. 2 and 8 of the drawings, when a tablet, sheets of paper or the like are positioned beneath the clip 28, the upper edge thereof abuts the outer ends of the feet 32.

Figure 2:
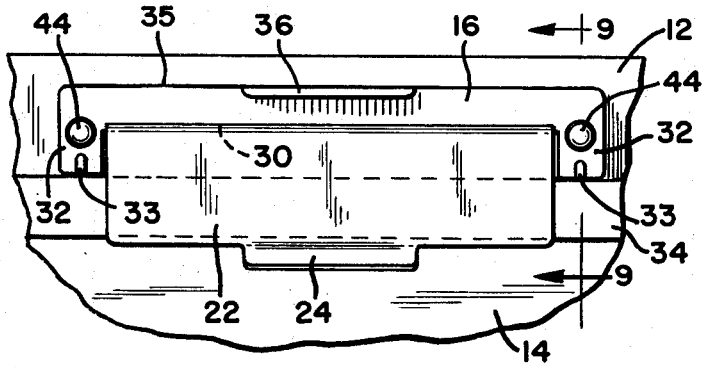
FIG. 2 is an enlarged plan view of the clip and portions of the related structure of FIG. 1.
Figure 3:
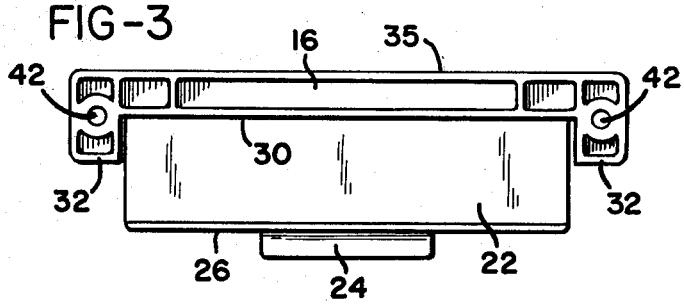
FIG. 3 is a bottom view of the clip of the present invention.

A common type of tablet construction utilizes a head strip, as seen at 34 in FIGS. 1, 2 and 8 of the drawings. Preferably the length of the wall 22 is proportioned relative to the length of the feet 32 such that the gripping portion 26 lies just beneath the lower edge of the head strip 34.

As noted above, improved resiliency of the spring 28 is provided through the use of a relatively long wall 22. This resiliency is further increased by extending the wall 20 up a substantial distance above the upper surface of the base portion 16. However, this results in a fairly wide space between the upper surface of the feet 32 and the lower surface of the wall 22. As a result, a tablet, sheets of paper or the like held by the clip might be dislodged upwardly into the space above the surface of the feet 32. To decrease the possibility of this occuring, protrusions 33 may be provided extending upwardly above the upper surface of the feet 32, as best seen in FIGS. 2, 6, 7 and 8 of the drawings.

Extending upwardly and approximately parallel to the wall 20 adjacent the rear edge 35 of the base is a third wall 36 which defines with wall 20 a slot 38 adapted to receive a pen, pencil or other writing utensil 40, as seen in FIG. 8 of the drawings. The wall 36 slopes downwardly and outwardly to prevent the member 40 from being accidentally dislodged.

Figure 9:
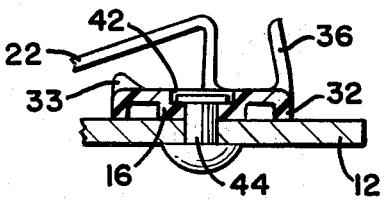
FIG. 9 is an enlarged cross-sectional view of the clip and a portion of a supporting surface showing one method of attaching the clip to the supporting surface.
Figure 5:
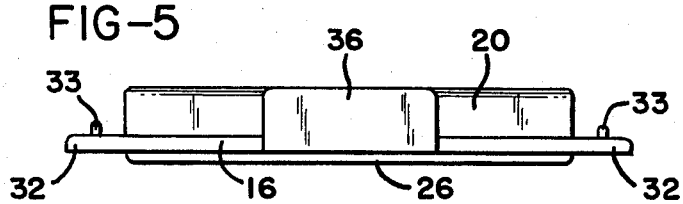
FIG. 5 is a view similar to FIG. 4, but showing the opposite side of the clip.
Figure 10:
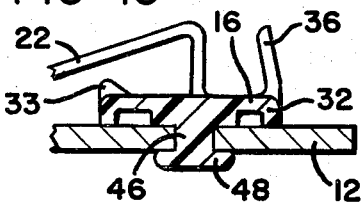
FIG. 10 is a view similar to FIG. 9, but showing another preferred embodiment of the invention.

As seen in FIG. 9 of the drawings, the clip 10 may be provided with counter sunk openings 42 receiving rivets 44 and securing the clip to a supporting surface 12. Alternatively, studs 46 may be formed integrally with the clip as seen in FIG. 10, and the lower ends 48 of the studs 46 enlarged by, for example, ultrasonic welding techniques, to attach the clip to a supporting surface 12.

While the forms of apparatus herein described constitute preferred embodiments of the invention, it is to be understood that the invention is not limited to these precise forms of apparatus, and that changes may be made therein without departing from the scope of the invention.

What is claimed is:

1. A clip comprising:

a. a base having upper and lower surfaces and forward and rear edges, b. a first wall projecting upwardly a substantial distance above said upper surface of said base at said forward edge thereof, c. a second wall projecting downwardly and forwardly from an upper edge of said first wall, d. said second wall being greater than a plurality of times the length of said first wall, e. said second wall terminating in a gripping portion disposed in a plane beneath the plane of said lower surface of said base, f. feet projecting forwardly from said forward edge of said base beneath said second wall and diminishing the space between said forward edge of said base and said gripping portion of said second wall, g. attaching means for securing the clip to a supporting surface, h. said attaching means constituting the sole means of attachment for said clip to a supporting surface and being disposed approximately in line with the plane of said first wall and being partly in said base and said feet, i. said clip being of one-piece construction with the components thereof formed integrally with each other, j. said clip being molded from a synthetic resinous material, and k. protrustions projecting upwardly from outer ends of said feet diminishing the space between said outer ends of said feet and a lower surface of said second wall.

2. The clip of claim 1 further comprising:

a. a third wall projecting upwardly from said rear edge of said base in spaced relationship to said first wall and defining therewith a slot adapted to receive a writing utensil.

3. The clip of claim 1 wherein:

a. said synthetic resinous material comprises an acetal resin.

4. The clip of claim 1 wherein:

a. said attaching means comprises studs formed integrally with said clip and projecting downwardly beneath said lower surface of said base and said feet.

* * * * *